US009986630B2

(12) United States Patent
Subotic

(10) Patent No.: US 9,986,630 B2
(45) Date of Patent: May 29, 2018

(54) SUPERCONDUCTING MAGNET WINDING STRUCTURES FOR THE GENERATION OF IRON-FREE AIR CORE CYCLOTRON MAGNETIC FIELD PROFILES

(71) Applicant: Krunoslav Subotic, Salt Lake City, UT (US)

(72) Inventor: Krunoslav Subotic, Salt Lake City, UT (US)

( * ) Notice: Subject to any disclaimer, the term of this patent is extended or adjusted under 35 U.S.C. 154(b) by 56 days.

(21) Appl. No.: 15/165,274

(22) Filed: May 26, 2016

(65) Prior Publication Data

US 2016/0381780 A1 Dec. 29, 2016

Related U.S. Application Data

(60) Provisional application No. 62/166,580, filed on May 26, 2015.

(51) Int. Cl.

| | |
|---|---|
| ***H05H 7/04*** | (2006.01) |
| ***H01F 6/06*** | (2006.01) |
| ***H01F 5/02*** | (2006.01) |
| ***H05H 13/00*** | (2006.01) |

(52) U.S. Cl.
CPC ..... *H05H 7/04* (2013.01); *H01F 5/02* (2013.01); *H01F 6/06* (2013.01); *H05H 13/005* (2013.01)

(58) Field of Classification Search
None
See application file for complete search history.

(56) References Cited

U.S. PATENT DOCUMENTS

2009/0083967 A1* 4/2009 Meinke ..... G01R 33/34007 29/602.1
2014/0231859 A1* 8/2014 Kim ..... H01L 33/38 257/99

* cited by examiner

*Primary Examiner* — Ashok Patel
(74) *Attorney, Agent, or Firm* — Michael F. Krieger; Kirton McConkie

(57) ABSTRACT

A superconducting air core cyclotron that replaces the iron core flutter field structure with an active superconducting wire structure with a superconducting main coil generating an isochronous field, and superconducting compensation coils generating the magnetic shield for the magnetic structure.

11 Claims, 8 Drawing Sheets

FIG 1A
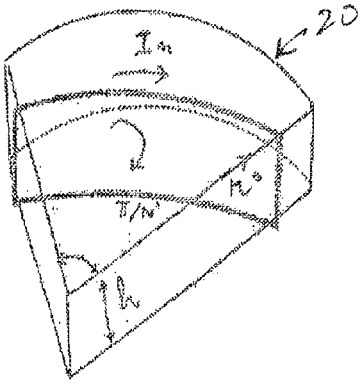
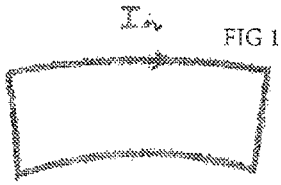
FIG 1B
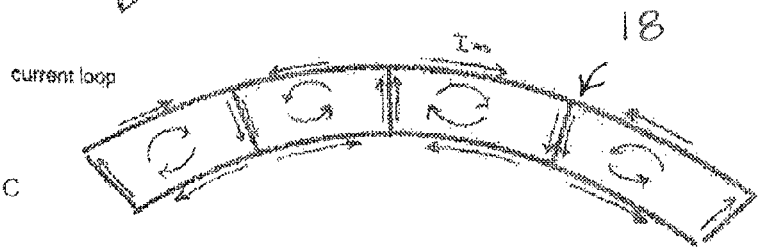
FIG 1C
FIG 1D
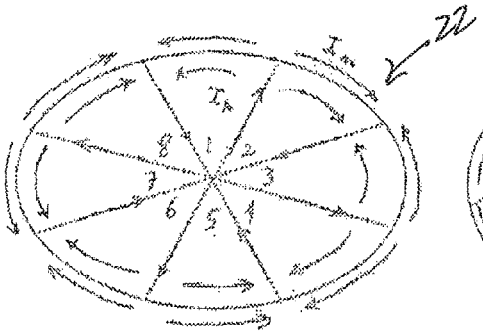
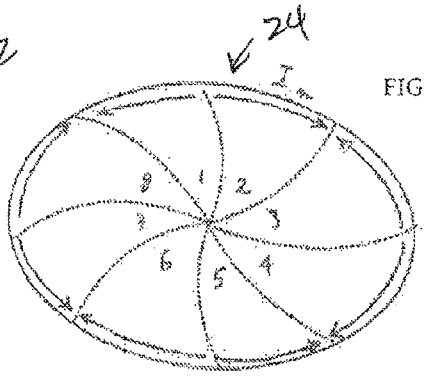
FIG 1E

SUPERCONDUCTING MAGNET WINDING STRUCTURES FOR THE GENERATION OF IRON-FREE AIR CORE CYCLOTRON MAGNETIC FIELD PROFILES

CROSS-REFERENCE TO RELATED APPLICATIONS

This application claims priority to U.S. Provisional Patent Application No. 62/166,580 filed on May 26, 2015.

BACKGROUND OF THE INVENTION

Cyclotrons are particle accelerator machines, that apply magnetic and RF electrical fields to accelerate a particle beam. Ions forming a beam are produced in the ion source, extracted from it, energized and injected into cyclotron orbits in a cyclotron's x-y median plane that is normal to the applied magnetic field B along its z axis.

BRIEF SUMMARY OF THE INVENTION

Beams of protons or heavier ions, can be produced in accelerators and used for medical, scientific, and security applications. When accelerated to precisely calculated energies, ions can be accurately targeted to tumors, even if they are dangerously shaped or positioned such as when surrounding the spinal cord, or close to the optic nerve, or in the center of the brain. Properly targeted, hadron beams could put virtually all their energy into the tumor, destroying it while limiting the damage to other tissues. High-energy proton cyclotron beams, are becoming a leading tool in radiation therapy. Heavy ion carbon (C) beam machines are considered to be their more efficient successors. To become realizable in medical applications these machines need to be of proper size and weight, to enable installation on a rotation table. Prior devices, such as the Heidelberg synchrotron require expensive auxiliary equipment to handle the beam which makes the use of the device no longer cost-effective. Cyclotron machines of the current iron core I (copper wired) and II (superconducting wired) generation are more compact and easier to position. The Mevion 250 Mev proton beam synchrocyclotron is so compact that it solves some of the size-related problems when installing the machine on the rotation table for applications. Cyclotron machines producing carbon (C) beams, however, as shown in preliminary design, are too large and heavy (6.5 meters in diameter and 700 tons in weight, according to feasibility studies of the superconducting version) to be mountable on the rotation platform. These problems have led to the present invention which utilizes air core high field superconducting isochronous cyclotrons that are iron-less, with magnetic structure made only from superconducting cables.

Superconducting air core cyclotrons replace the iron core flutter field structure with an active superconducting wire structure which generates a flutter field. The main coil enabling generation of an isochronous field is also a pure superconducting winding made on a spherical, pancake or cylindrical coil former.

Prior art cyclotrons of the first generation used copper wire coils to excite the iron that produces the significant part of required flutter and isochronous field profiles. Field values attained were usually not higher than 2 T. Improved second generation cyclotrons applied the superconducting main coil's wiring to achieve 5 T, while at the same time reducing the size and weight of the machine. Effects of the iron saturation in prior devices are some of the limiting factors for the use of the iron structure in operation of the flutter. This problem is solved in embodiments of the present invention by introducing active superconducting wire structures instead of iron sectors. Application of superconducting wire in main and compensation coils enables the construction of a yokeless air core superconducting cyclotron

BRIEF DESCRIPTION OF THE SEVERAL VIEWS OF THE DRAWINGS

FIG. 1*a* shows a sector coil former;

FIG. 1*b* shows a winding;

FIG. 1*c* shows a portion of a b belt's chain;

FIG. 1*d* shows a map of radial sector coil formers;

FIG. 1*e* shows a map of spiral sector coil formers;

DETAILED DESCRIPTION OF THE INVENTION

Figure 2A:
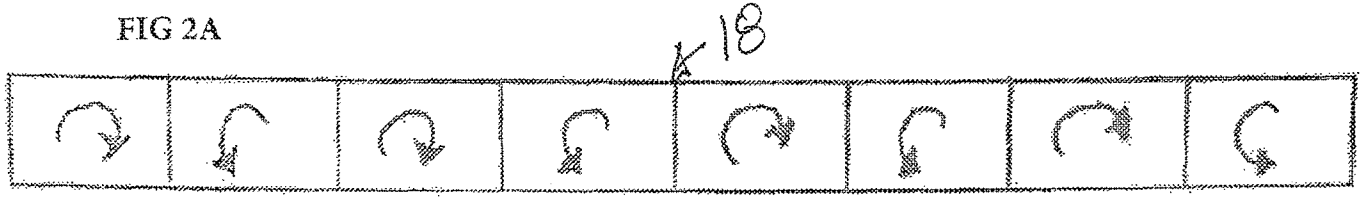
FIGS. 2*a* and 2*b* show chain type electrical connection of the windings of a belt.

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

FIG. 1*a*-1*e* shows a typical winding used to construct the circular belts 18 of different radii $r_o$, where each of the belts consists of a chain of electrically connected superconductor links (windings), that follow the shape of the form of the perimeter normal to the radius cross section area of 2N' coil formers of the shape of the radial or spiral sectors of width π/N' and height h.

Various embodiments of sector coil formers are shown such as: (FIG. 1*a*) a sector coil former 20 of angular width π/N' and height h; (FIG. 1*b*) a winding of current $I_n$ that is following the shape of 'normal to radius perimeter' of the cross section of the sector at position of radius $r_0$; Winding represents the link of the "chain" that is forming the belt 18 of radius $r_0$; (FIG. 1*c*) Part of the belt's chain constructed from links described at FIG. 1*a* and FIG. 1*b*, where the assigned current loop ($I_n$)) alternates the sign at each of the successive sector's positions; Following directions of current I indicates how the belt can be coiled continuously from the single cable. (FIG. 1*d*) Map of the radial sector coil formers, and current loops used for the windings described in FIGS. 1*a*, 1*b*, and 1*c*, that have the shape of the perimeter of 'normal to the radius' sector's projection profile, at given radius $r_o$. In this case the 'normal to the orbit plane' component of the field B is produced only by tangential current ($I_t$) components in the windings. As indicated in FIG. 1*d* the radial coil formers 22 and the spiral coil formers 24 also can be used to carry 'in plane' windings that follow the shape of the perimeter of the sector as it is projected to the median plane; In this version the 'normal to the orbit plane' component of the field B is produced by tangential ($I_n$) and radial current components ($I_p$) in the windings. (FIG. 1*e*) Map of the spiral sector coil formers with properties described at FIG. 1*d*.

Figure 2B:
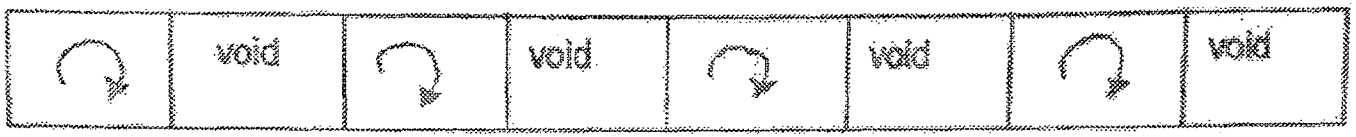

FIGS. 2*a* and 2*b* show a method of 'chain' type electrical connections of the windings in the belt according to FIG. 1*a*, (FIG. 2*a*) showing the alternate signs for successive current loops of the links of the chains and (FIG. 2*b*) showing the principle of the same sign of current loop of each second link of the chain with no links between.

Figure 3:
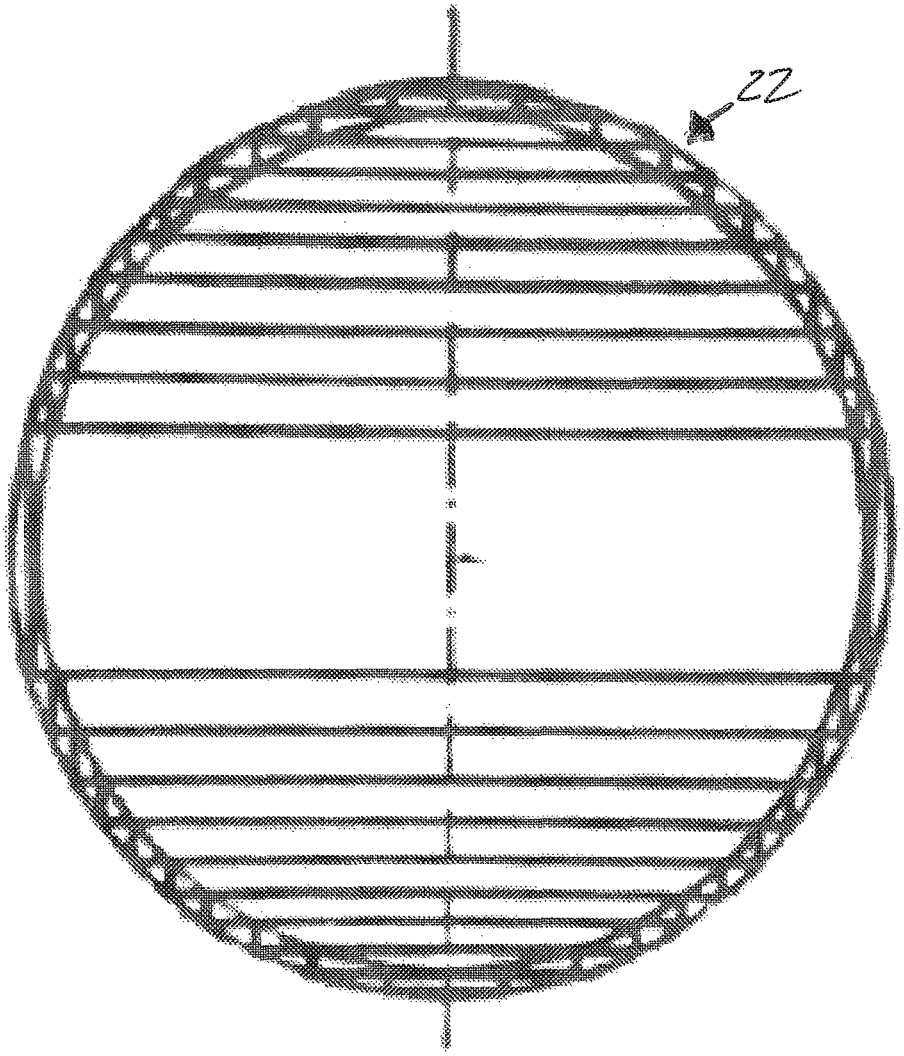
FIG. 3 shows a spherical coil former.

FIG. 3 shows a spherical coil former 22 for windings that are used to generate isochronous field profiles and compensation field profile.

Figure 4:
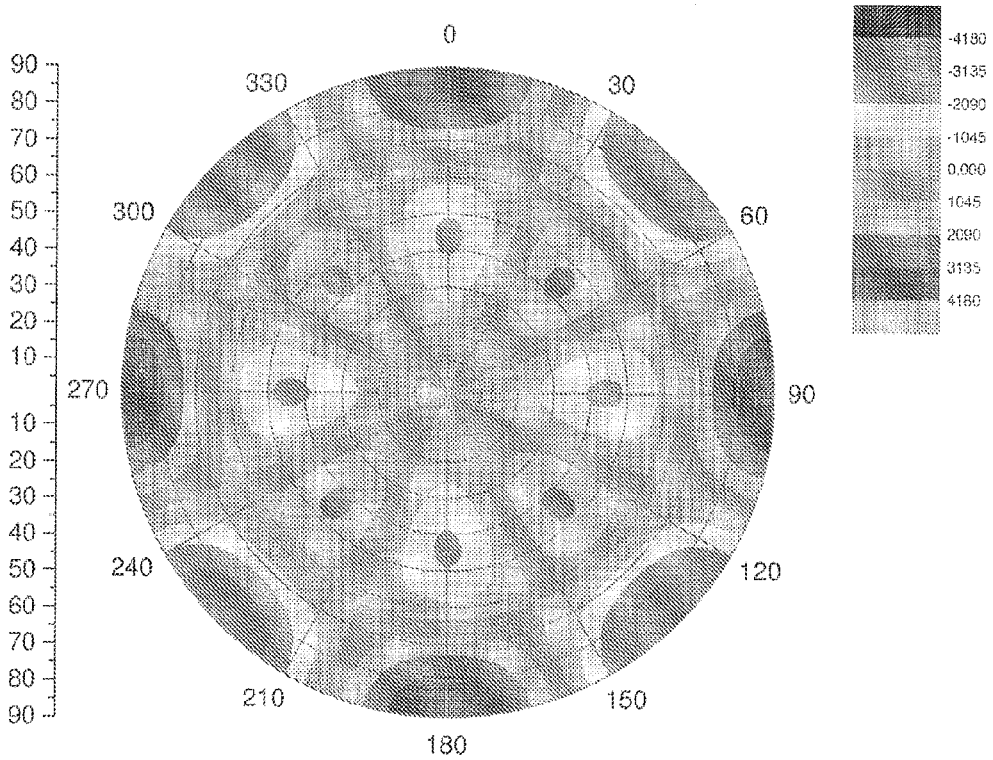
FIG. 4 shows iso-contoors.

FIG. 4 shows iso-contours of the azimuthal angle component (in polar spherical coordinate system $r,\Phi,\theta_0$) of the linear current density of the contours, at the field symmetry number N'=4. Note the interchange of signs of current loops at successive sectors. Iso-contours of azimuthal angle component can be produced in basically the same way as is it is done for belt type structure in FIG. 2. This could be done using the rectangular superconducting frames normal to the radius of the spherical coil former on which they are laying. Upper horizontal edge is providing current flow of negative sign (red/brown colors at polar angle spot of 45° at FIG. 4), lower edge is providing azimuthal current flow of positive sign (blue colors at polar angle spot at 90°. Current components along vertical edges of the frame are not producing significant field component responsible for particle motion in orbit plane. Intensities of azimuthal current components at blue and red/brown current spots are defined in terms of the number and lengths of horizontal edges of added inner and outer frames, where their positions and sizes of edges are determined by using formulae describing azimuthal and polar angle dependence of azimuthal current density, as given above.

Figure 5:
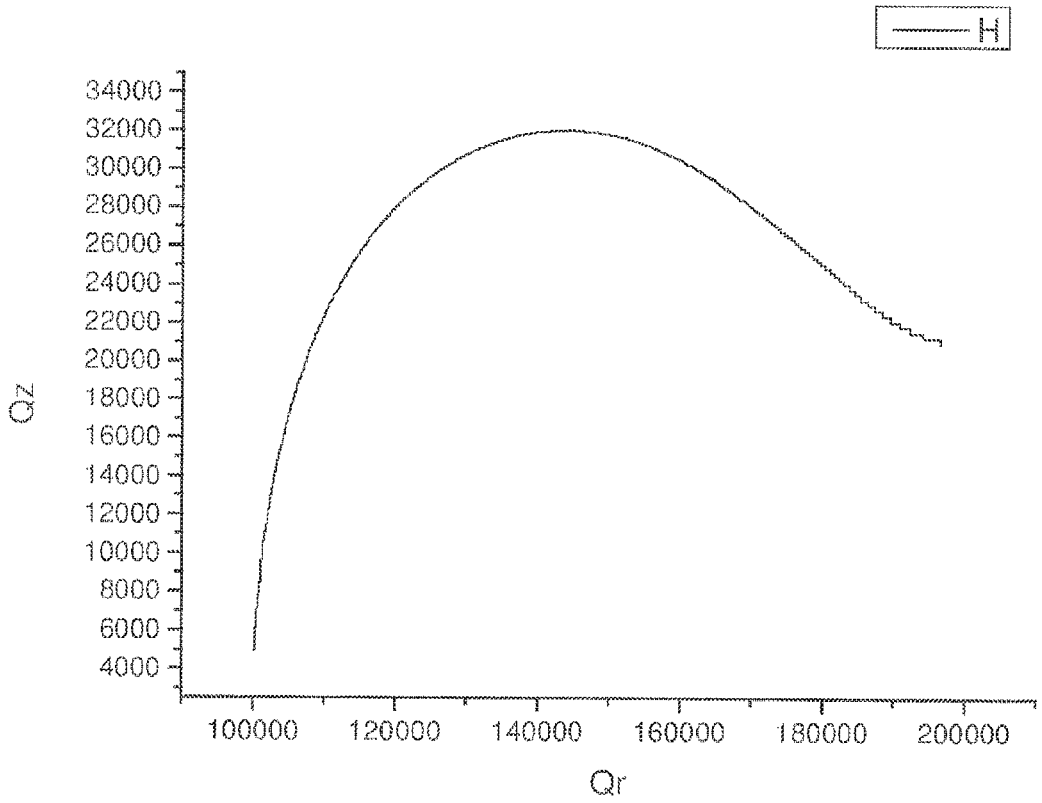
FIG. 5 shows the orbital frequency of an axial mode versus the orbital frequency of a radial mode.

FIG. 5 shows the orbit frequency of axial mode versus per orbit frequency of radial mode (units multipled by factor $10^5$ to illustrate the smoothness of the function).

Figure 6:
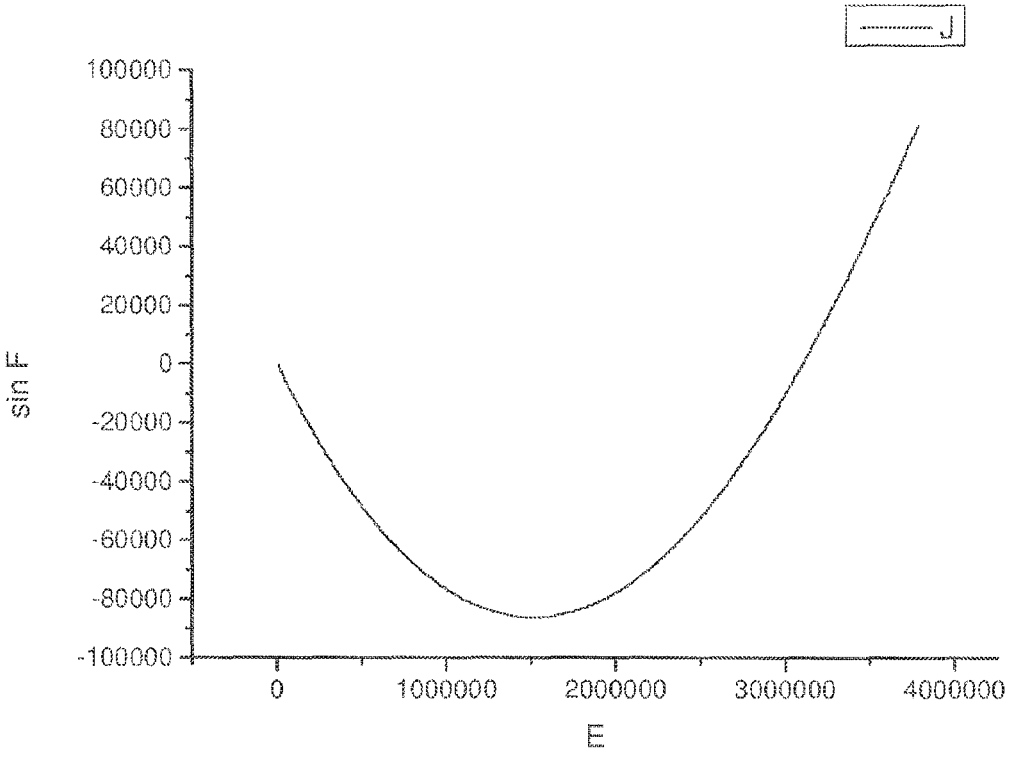
FIG. 6 shows a sin F (phase clip) as a function of energy/nucleon in MeV/amv (units multiplied by a factor of $10^3$).

FIG. 6 shows sin F (phase slip) as a function of energy energy/nucleon in MeV/amu (units multipled by factor $10^5$).

Figure 7:
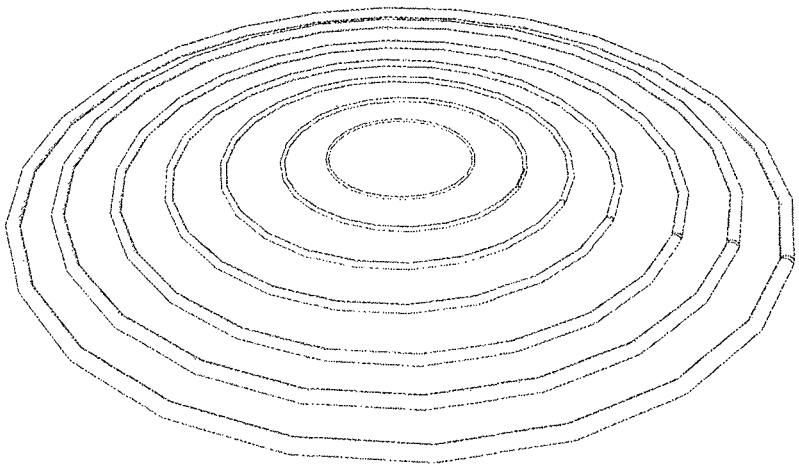
FIG. 7 shows a pancake coil winding.

FIG. 7 shows a pancake coil winding.

Figure 8:
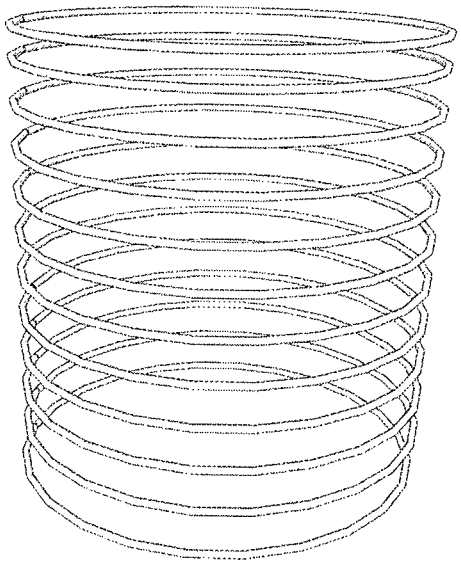
FIG. 8 shows a cylindrical coil winding.

FIG. 8 shows a cylindrical coil winding.

Curvature of a particle's equilibrium orbit of radius r is determined by the expression rB=p/q, where r is the radius of the circular path of the particle of charge q and impulse p, that obeys motion in median plane, normal to applied magnetic field B. Unavoidable sources of instability in particle motion along the equilibrium orbit are controlled by flutter magnetic field structures, that produce azimuthal variation of magnetic field B, enabling the focusing effects on small oscillatory motions of a particle along EO. A beam of particles of constant charge to mass ratio q/m orbits with constant angular frequency exposed as w=Bq/m. An RF electric field is then used to add energy to the particle at each orbit turn. Thus a particle experiences the spiral trajectory increasing radius of EO coming to the point at which it is extracted from the cyclotron and used. The particle's mass becomes increased with radius of the orbit r, due to relativistic effects. In order to retain the same value of q/m B=w, the magnetic field value should increase with the radius of the equilibrium orbit EO. Increased field values are building the effective isochronous field B=gBo, where g is a relativistic factor $g=1/(1-(rw/c)^2)^{1/2}$ and Bo is field value at r=0. Thus the two essential components of isochronous cyclotrons are magnetic field structures to support the generation of the flutter and isochronous field profiles.

Structures of the superconducting windings provide for the generation of iron-free air core cyclotron flutter fields and isochronous field profiles. The present invention has two primary embodiments:

The first embodiment is a belt-type structure of superconducting windings of the cyclotron's flutter and associated isochronous field profiles. The second embodiment is a spherical shell-type structure of the cyclotron's windings to generate the same magnetic field profiles. In the first embodiment, a flutter field of $B_f$ configuration, the periodicity of which is chosen by the N' number of the symmetry of the cyclotron magnetic field is built of N circular belts of different radii $r_o$, where each of the belts consists of the chain of electrically connected links that follow the shape of the form of the perimeter 'normal to the cross-section area of 2N'' coil formers of the shape of radial or spiral sectors of width π/N' and height h. The current loops of the chain links, i.e. windings of the above described shapes, alternates sign with each successive sector of the chain. The average field value of this chain has zero value. 'Chain' type electrical connection of the windings in the belt enables application of continuous superconducting cable at winding of each belt. The belt can be constructed from separate superconducting, independently supplied, frames of the form of the perimeter of the normal to the radius cross section area of the above described coil formers. Also, instead of having links connected as the chain of current loops of alternate signs, the belt can be constructed from links of the same sign of the current's loops as the links that are located at positions at each second sector of cyclotron magnetic field, with no links located at position between them. In this case flutter field structure produces non-zero values of average magnetic field that can be used as component of the cyclotron isochronous field B. The number of belts N equals the number of the fitted r dependent values of the designed flutter field profile. Each belt has an identical symmetric partner with regard to the median plane.

Isochronous field B is built by applying, symmetric regarding the median plane, circular windings on a designed cylindrical, pancake or spherical coil former. The number of coil pairs equals the number of fitted values of the designed isochronous field B.

Current supplies of the windings are solutions of equations Ax=B, where A is the matrix of coefficients of the above-described coil formers applied to generate the designed flutter and isochronous magnetic field profiles, x is a column matrix of the applied current values, and B is the column matrix of the fitted values of the magnetic field profiles.

A magnetic shield of this ironless structure is based on the use of the spherical coil or cylindrical formers, with a current set-up determined by the method described above.

The designed harmonics of the magnetic field are generated by choices of independent current supplies of particular links, i.e. current loops of the given belt's chain.

A second embodiment is presented with a spherical shell type structure of superconducting windings of a cyclotron's flutter field and associated isochronous field profiles for field symmetry numbers: N'=4 and N'=3.

The flutter field $B_f$ profile is built using a set of mathematically defined superconducting wire contours applied on the surfaces of 2N' successive sectors of width π/N', of N spherical shells of given different radii $r_o$. 'Chain' type electrical connection of the windings of the contours allows continuous winding of the chosen sets of the contours.

The respective azimuthal and polar angle components (in polar spherical coordinate system) of linear current density of contours at the field symmetry number N'=4 are given by the expressions:

$$\mu_0\zeta\Phi=\mu_0\zeta_0[\sin^5\theta_0-4\sin^3\theta_0\cos^2\theta_0]\cos 4\Phi$$

$$\mu_0\zeta_\theta=\mu_0\zeta_0[0-4\sin^3\theta_0\cos\theta_0]\sin 4\Phi$$

where $\zeta_0=11/3\ a_n$, and where $a_n$ is the designed nominal current density of contours laying on spherical surface (shell #=n) at radius $r_o$. Linear current density $\zeta=dI/dl$ of the contours is determined by expression ($\mu_0$ is vacuum magnetic permeability)

$$\mu_0\zeta=\mu_0(\zeta_\Phi^2+\zeta_\theta^2)^{1/2}=\mu_0\zeta_0\{[(\sin^5\theta_0-4\sin^3\theta_0\cos^2\theta_0)\cos 4\Phi]^2+[(0-4\sin^3\theta_0\cos\theta_0)\sin 4\Phi]^2\}^{1/2}$$

where by definition, with each successive sector, the current loop alternates the sign. In this case the average magnetic field has zero value.

Isochronous field B is built by applying the pancake coil former of circular windings of the set of N radii in the plane of height h, or using the cylindrical coil former where N is equal to the number of fitted values of isochronous field B profile. Flutter field produced by contour of the shell of radius $r_0$ is given by equations:

$$B_{4i}=2a_n(r/r_o)^4\cos 4\Phi,\ \text{for}\ r<r_o$$

$$B_{4e}=-2a_n(r_0/r)^7\cos 4\Phi\ \text{at}\ r>r_o$$

Flutter field profile can be also derived using sample of the current contour of the one of the 2N' sectors, applying it at each second sector with no applications of current contours on the sectors between. In this case average field of flutter structure is different from zero and can be used as the component of the isochronous field B profile.

Circular coil's average field is given by:

$$B_i=\mu_0 I\sin^2\theta_0/(2r_0)\{1+9/4(1-5\cos^2\theta_0)(r/r_0)^2\}$$

$$B_e=-\mu_0 I\sin^2\theta_0/(2r_0)\{(r_0/r)^2+9/4(1-5\cos^2\theta_0)(r_o/r)^5\},$$

where r is radius of the field's point, while $r_0$ and $\theta_0$ are values of radius and polar angle of the position of the circular coil.

The respective azimuthal and polar angle components (in polar spherical coordinate system) of linear current density of contours at the field symmetry number N'=3 are given by the expressions:

$$\mu_0\zeta_\Phi\mu_0\zeta_0[\sin^4\theta_0-3\sin^2\theta_0\cos^2\theta_0]\cos 3\Phi$$

$$\mu_0\zeta_\theta=\mu_0\zeta_0[0-3\sin^2\theta_0\cos\theta_0]\sin 3\Phi$$

where $\zeta_0=-18/5a_n$, and where $a_n$ is the designed nominal current density of contours laying on spherical surface (shell #=n) at radius $r_o$. Linear current density $\zeta=dI/dl$ of the contours is determined by expression ($\mu_0$ is vacuum magnetic permeability)

$$\mu_0\zeta=\mu_0(\zeta_\Phi^2+\zeta_\theta^2)^{1/2}=\zeta_0\{[(\sin^4\theta_0-3\sin^2\theta_0\cos^2\theta_0)\cos 3\Phi]^2+[(0-3\sin^2\theta_0\cos\theta_0)\sin 3\Phi]^2\}^{1/2}$$

where by definition, with each successive sector, the current loop alternates the sign. In this case the average magnetic field has zero value.

Isochronous field B is built by applying the pancake coil former of circular windings of the set of N radii in the plane of height h, or using the cylindrical coil former where N is equal to the number of fitted values of isochronous field B profile. Flutter field produced by contour of the shell of radius $r_0$ is given by equations:

$$B_{3i}=a_n(r/r_o)^3\cos 3\Phi,\ \text{at}\ r<r_o$$

$$B_{3e}=-a_n(r_0/r)^6\cos 3\Phi\ \text{at}\ r>r_o$$

Flutter field profile can be also derived using sample of the current contour of the one of the 2N' sectors, applying it at each second sector with no applications of current contours on the sectors between. In this case average field of flutter structure is different from zero and can be used as the component of the isochronous field B profile.

Circular coil's average field does not dependent on the field symmetry and is given as above.

Current supplies of the windings are determined by solving equation Ax=B, where A is the matrix of coefficients of spherical/cylindrical/pancake coil formers, x is column matrix of the current values applied, and B is the column matrix of the fitted field values.

Magnetic shield of this ironless structure is based on the use of the spherical coil formers, with a current set up determined by method described above.

Designed harmonics of magnetic field are generated by choices of independent current supplies at corresponding contours of spherical or cylindrical coil formers.

Checking of Validity of Applied Concepts

In order to check the validity of proposed patent solutions the special sophisticate computer methods based on Gordon's NSCL/MSU codes and Hagedorn analytical theory are developed and applied which immediate runs can confirm the validity of design concept applied:

1. Confirming the optimal choice of the parameters of the cyclotron design by proper choice of amplitudes of the flutter field harmonics and shape of isochronous cyclotron field
2. Confirming the stability of oscillation in radial and axial EO oscillatory mode
3. Confirming the choice of the shape of isochronous field which keeps particle in optimal phase slip versus the applied RF field
4. Confirming the smoothness of radial mode and axial mode frequency dependences of energy, relevant for efficient fitting of isochronous and flutter field profile by applied magnetic field structures, in terms of applied number of isochronous and flutter field coil formers
5. Confirming the realistic hardware solutions of superconducting technology, that safely generate the required profiles of magnetic isochronous and flutter field, via shell type and/or belt type design.
6. Checking of limiting factors of 'large gap' mode supporting the high beam intensity applications
7. Checking of optimal parameters of the system of spherical formers for magnetic field shielding
8. Confirming stability of orbit frequency of axial versus radial oscillatory mode, satisfying standard criteria for carbon energy of 380 MeV/nucleon beam, at extraction radius of 78 cm, and associated stability of phase slip diagram satisfying large gap criteria for the 'shell type' air core cyclotron, as shown in FIGS. 5 and 6, at central field value of 6.13 T, and superconducting cyclotron technology, supporting design requirements for current densities at 200 kA/cm$^2$ for $Nb_3$ Sn and 2000 kA/cm$^2$ for YBCO cables at superconductor versus Cu ratio 1:3.

What is claimed is:

1. An air core cyclotron, comprising:

a belt-type superconducting structure to generate a flutter field profile; and a coil former for superconducting windings to generate an isochronous field and shield field profiles.

2. The air core cyclotron as recited in claim 1, wherein the generation of flutter field isochronous field profiles uses the coefficients of the applied coil formers according to the equation Ax=B, where x is the current vector, A is the matrix of coefficients of coil formers and B is the vector of the fitted field values.

3. The air core cyclotron as recited in claim 1, wherein the coil former is a spherical coil.

4. The air core cyclotron as recited in claim 1, wherein the coil former is a pancake coil.

5. The air core cyclotron as recited in claim 1, wherein said superconducting structure has a belt formed by links of a chain having a form that coincides with the shapes of current loops of the chain, said loops being normal to the radius or spiral line of the perimeter of the cross sectional area of a radial or spiral sector applied.

6. The air core cyclotron as recited in claim 1, further comprising a chain-type electrical connection of the windings in the belt.

7. The air core cyclotron as recited in claim 5, wherein the current loops of the chain links have alternating positive and negative polarities with each successive link of the chain.

8. The air core cyclotron as recited in claim 7, wherein the belt is constructed of links of the same polarity as the as the polarity of the corresponding current loops which are located in positions at alternating sectors of the magnetic field.

9. The air core cyclotron as recited in claim 7, wherein a designed harmonic of the magnetic field is generated by varying an independent current supply to a link.

10. The air core cyclotron as recited in claim 7, wherein the current loops are positioned in sectors and wherein the flutter field profile is constructed by repeating a shape of and the polarity of the current loop of one of the alternating at each second sector with no contours between.

11. The air core cyclotron as recited in claim 5 wherein each current loop has an alternating polarity when a flutter field is produced by in-plane windings that follow the form of a sector's perimeter.

* * * * *